US005310194A

United States Patent [19]

Scheel

[11] Patent Number: 5,310,194

[45] Date of Patent: May 10, 1994

[54] CENTRIFUGALLY LAUNCHED PROJECTILE RECREATIONAL DEVICE

[76] Inventor: Kenneth R. Scheel, Rte. 4, Box 340, Elkton, Va. 22827

[21] Appl. No.: 997,504

[22] Filed: Dec. 28, 1992

[51] Int. Cl.[5] ..... A63B 65/00

[52] U.S. Cl. ..... 273/415; 273/428

[58] Field of Search ..... 273/428, 415, 58 K, 273/58 C, 58 R

[56] References Cited

U.S. PATENT DOCUMENTS

| | | | |
|---|---|---|---|
| Re. 34,032 | 8/1992 | Callaghan | 273/428 |
| 1,081,037 | 12/1913 | Hackh . | |
| 2,311,160 | 2/1943 | Dobbelaar | 124/5 |
| 3,163,421 | 12/1964 | Matyko | 273/106 |
| 3,368,815 | 2/1968 | Alabastro | 273/106 |
| 3,393,911 | 7/1968 | Lawson | 273/106 |
| 3,480,280 | 11/1969 | Gamertsfelder | 273/106 |
| 3,862,757 | 1/1975 | Craig, II | 273/58 C |
| 4,088,319 | 5/1978 | Clarke | 273/58 R |
| 4,127,268 | 11/1978 | Lindgren | 273/58 C |
| 4,151,994 | 5/1979 | Stalberger, Jr. | 273/58 A |
| 4,294,447 | 10/1981 | Clark | 273/58 R |
| 4,354,679 | 10/1982 | Steinmetz | 273/58 A |
| 4,657,253 | 4/1987 | Lerner et al. | 273/58 A |
| 4,696,472 | 9/1987 | Meyer | 273/58 A |
| 4,717,158 | 1/1988 | Pennisi | 273/58 A |
| 4,826,179 | 5/1989 | Callaghan | 273/428 |
| 4,943,066 | 7/1990 | Lathim et al. | 273/415 |
| 5,112,061 | 5/1992 | Lamle | 273/411 |

OTHER PUBLICATIONS

*The New Games Book*-published 1976, p. 27.

*Primary Examiner*—Paul E. Shapiro

[57] ABSTRACT

A centrifugally launched recreational device that consists of a weighted nose section containing a non-resilient particulate filled sack, a narrow aerodynamic cloth-like body extending from the nose section and a wider gripping section at the end opposite the nose section. The gripping section contains a soft lightweight mass such as closed cell foam which allows throwing and catching the device with a loose grip and minimal strength or effort. The device is grasped by the gripping section, spun and released to be caught by either the nose section or the trailing portion. The device may be used for most any game that involves throwing or catching an object.

11 Claims, 2 Drawing Sheets

CENTRIFUGALLY LAUNCHED PROJECTILE RECREATIONAL DEVICE

FIELD OF THE INVENTION

This invention relates generally to recreational devices, and more particularly to a centrifugally launched projectile device which is uniquely easy and satisfying to throw and catch.

BACKGROUND OF THE INVENTION

Several configurations for centrifugally launched projectile toys have been described in the art. Callaghan (U.S. Pat. No. Re. 34,032) and Lawson (U.S. Pat. No. 3,343,911) describe a projectile toy with a cloth-like tail that tapers from the weighted nose to a point at the tip of the tail. The tail is the widest at the weighted end which will be traveling at the greatest rotational velocity when the device is spun prior to launching. This results in excessive air drag which reduces the launching velocity. This tail design also limits the ease with which the toy can be caught by the tail. The ease of catching the tail increases the further the catch is removed from the nose. Yet, the taper shaped tail provides diminishing tail substance to grasp, increasing the catch difficulty. Individuals without excellent reflexes experience frustration as the thin tail section slips out from between their fingers during a catch attempt.

Previously described centrifugally launched projectile toys have used a resilient mass such as a rubber ball as the weight in the nose section. This includes the Callaghan and Lawson toys as well as Clark (U.S. Pat. No. 4,294,447), Clarke (U.S. Pat. No. 4,088,319), Craig II (U.S. Pat. No. 3,862,757), Lerner et al. (U.S. Pat. No. 4,657,253), Lindgren (U.S. Pat. No. 4,127,268) and Meyer (U.S. Pat. No. 4,696,472). Lamle (U.S. Pat. No. 5,112,061) describes a single round, resiliently compressible, unitary body mass filled with a gel and/or a liquid. Aninherent characteristic of a resilient mass is that it will bounce upon impact as it returns to its original shape. Therefore when a person attempts to catch a resilient mass it will bounce out of the catcher's hands unless the catcher has sufficient skill and reflexes to retain the mass.

*The New Games Book*, published in 1976 describes on page 27 a projectile toy that is constructed by placing a rubber ball in the toe of a sock then throwing and catching it by the sock tail. This is similar to the projectile toy described by Lamle that uses the resilient gel mass as the weight in the blind end of a sock-like tube. Although simple in design, this uniformly wide tail configuration creates undesirable drag while the device is spun prior to launching and during free flight. This significantly limits the free flight distance, especially in windy conditions such as at a beach—a common place to use toys such as these.

Lamle describes a hemmed trailing end and Lerner et al. describes a knot in the tail, both of which act as a finger grips. Although either configuration could act as a finger grip, a double thickness of fabric or a knot would still require significant hand strength of the user when throwing this toy by the tail to counteract the centrifugal force generated by the rotating weight.

Particulate filled sacks which act much like a bean bag have been described by Gamertsfelder (U.S. Pat. No. 3,480,280), Lathim et al. (U.S. Pat. No. 4,943,066), Matyko (U.S. Pat. No. 3,163,421), Pennisi (U.S. Pat. No. 4,717,158) Stalberger, Jr. (U.S. Pat. No. 4,151,994) and Steinmetz (U.S. Pat. No. 4,354,679). Each of these act as an easily catchable non-resilient mass but they are strictly limited in the distance they might be thrown by the arm strength of the thrower and conventional throwing techniques. None of these has ever been proposed to be used as the weighted portion of a centrifugally launched projectile device with a tail section designed to facilitate catching and throwing with an open relaxed hand.

SUMMARY OF THE INVENTION

This device consists of a bean bag type weight attached to a flexible cloth-like body with a gripping section at the end which is loosely grasped and used to swing and launch the device. It is caught by either the weighted end or the trailing portion.

The object of this invention is to provide an exciting recreational device that can be caught and thrown easily by an individual of virtually any skill, strength or coordination level. The ease with which this device can be caught and thrown allows individuals of even moderate athletic ability to make creative and spectacular throws and catches that cannot be achieved with any other projectile toy.

A disabled person in a wheelchair can throw this device significantly further than conventional throwing objects because a simple spinning motion generates enough momentum to carry the device a significant distance. A person with a disabled hand who would be unable to grip other centrifugally launched devices would be able to throw this invention because hand gripping strength is not required. This invention can be swung, thrown and caught with the hand open and relaxed.

A further advantage of this invention is that it can be used during all seasons of the year. Even while wearing heavy mittens or gloves, a user can easily throw and catch this device. Few other objects can be thrown and caught efficiently while wearing mittens or gloves.

The object by which this is accomplished is a centrifugally launched projectile device comprising:

a weighted nose section containing a non-resilient, impact absorbing deformable mass consisting of pellets or other particulate material in a partially filled closed flexible cloth-like sack;

a body section constructed of flexible cloth-like material which extends from the nose section and has a cross sectional area significantly smaller than the cross sectional area of the nose section;

a gripping section constructed of flexible cloth-like material extending from the body section at the end distal to the nose section. The gripping section has a wider cross sectional area than the body section and contains a soft, lightweight, resilient mass.

The device is used by loosely grasping the gripping section and swinging the device such that the weighted nose section rotates around the gripping section. The soft resilient mass in the gripping section allows the thrower to easily retain the device even with a relaxed grip. Great rotational velocity can be attained. When the device is released the rotational velocity translates to linear velocity in free flight with the body and gripping sections trailing directly behind the weighted nose section. Thus the device can be thrown a great distance with minimal strength or effort.

The device can be caught by either the weighted nose section or the gripping section. The non resilient particulate filled nose section absorbs the energy of impact as the particles shift within the nose section to conform to the impact surface. This allows the nose section to sink securely into the catcher's hands with no propensity to bounce out. When catching the device by the trailing portion, the catcher can grasp anywhere along the body section and as it slides through the hand, the wider gripping section containing a soft resilient mass will prevent the device from sliding out of the catcher's hand even if the hand is not fully closed.

The narrow body section eliminates all unnecessary air drag both during the swinging phase prior to launching and during free flight, thus achieving the greatest flight distance with minimum effort.

This projectile recreational device can be used for most any game that involves throwing or catching an object. For example, the game of 500 can be played by awarding 50 points for a catch by the nose section and 100 points for a catch on the trailing end which is usually more difficult to achieve. Further objects and advantages of this invention will become apparent from consideration of the drawings and ensuing description of it.

DESCRIPTION OF PREFERRED EMBODIMENT

Figure 1:
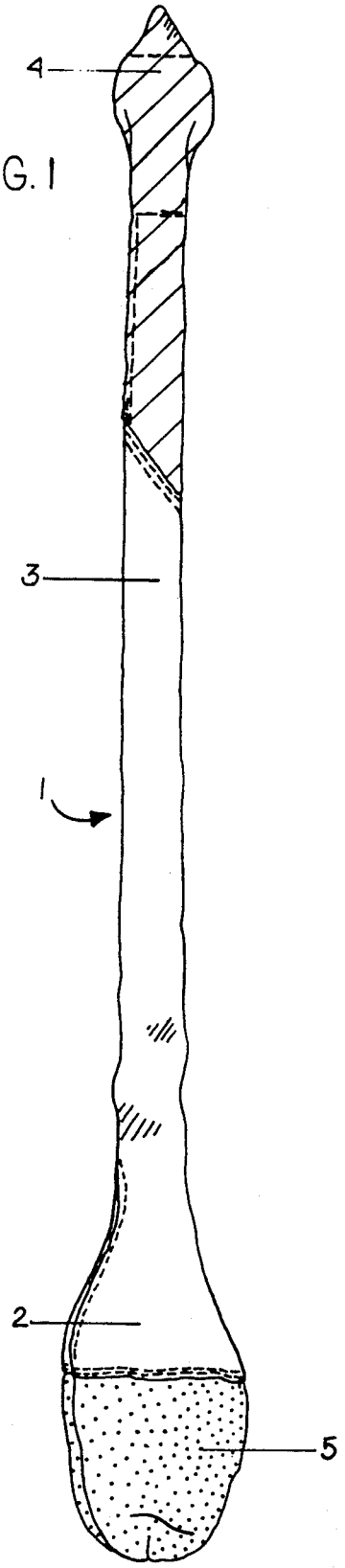
FIG. 1 is a perspective view of the projectile device in a flat condition.
Figure 2:
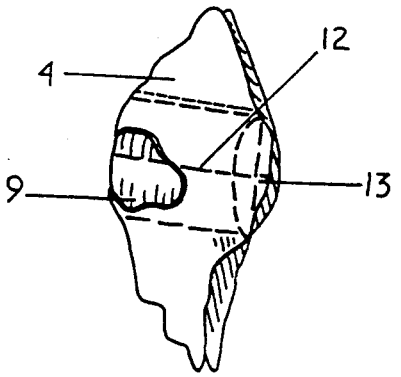
FIG. 2 is an enlarged fragmented view of the gripping section.
Figure 3:
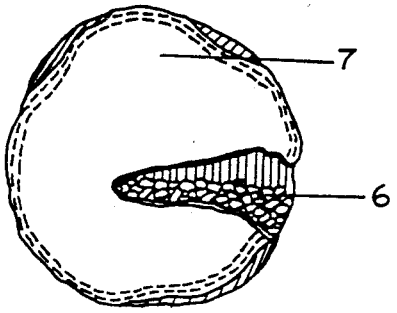
FIG. 3 is a perspective view of the particulate filled sack.
Figure 4:
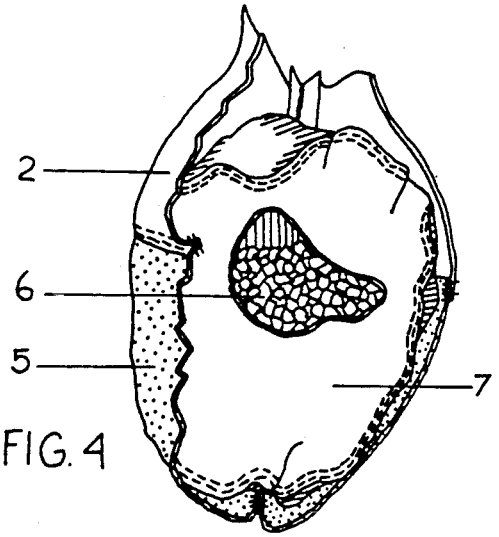
FIG. 4 is an enlarged fragmented view of the weighted nose section.
Figure 5:
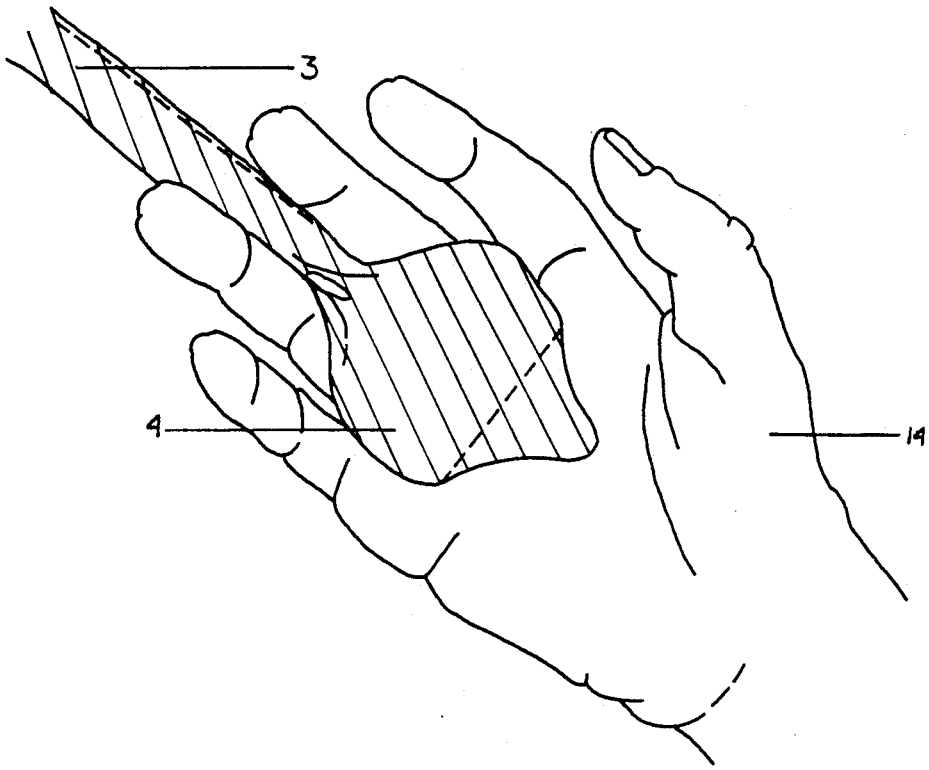
FIG. 5 is a view of one of the possible relaxed grips that can be used to throw or catch the device.

Referring to FIGS. 1-6, the device of the present invention is identified by the general reference 1. Each device 1 comprises a nose section 2, a body section 3 and a gripping section 4 which can be constructed with all the same material or any combination of materials such as leather, synthetic leather, nylon, vinyl, acetate, natural fibers, synthetic fibers or cloth-like material. These materials can be fastened together by glue or other means but are preferably stitched together. The nose section 2 is of a size such that the particulate material 6 occupies not more than 60% of the interior space of the nose section 2 to allow fluid-like movement of the particulate material 6 upon impact. The particulate material 6 may be disposed directly within the nose section 2 but an inner sack 7 is preferred to increase durability. The inner sack 7 must be approximately the same size as the nose section 2 so it does not restrict movement of the particulate material 6. The inner sack 7 is constructed of a durable material such as nylon. The particulate material 6 can be plastic pellets or beads, seeds, silicon particles, sand or other suitable natural or synthetic particulate material. Plastic pellets, or more specifically polyethylene pellets, are the preferred particulate material 6. The nose tip 5 is of a generally conical shape to enhance the aerodynamic affect. Leather is the preferred material for construction of the nose tip 5 to provide durability for repeated impact. The leather also acts as a cushion between the hand of the catcher and the particulate material 6 much like a baseball glove cushions the hand from a baseball.

The body section 3 and the gripping section 4 are preferably constructed of a flexible cloth-like lightweight durable material such as nylon. The cross sectional area of the body section 3 is distinctly smaller than the cross sectional area of the nose section 2 to minimize air drag when the device is spun and during free flight. The gripping section 4 and a portion of the body section 3 adjacent to the gripping section 4 are a color that contrasts with the rest of the device 1 to make it easier to see while in flight and therefor easier to catch.

The gripping section 4 has a wider cross sectional area than the body section 3 and is comprised of a lightweight durable mass 9 constructed of foam, plastic, cork, wood or other suitable synthetic or natural material. The mass 9 must be very lightweight to keep the trailing portion 3,4 following directly behind the nose section 2 during flight. If the gripping section 4 is too heavy, the trailing portion 3,4 will fishtail widely during flight and the device 1 becomes more difficult to catch.

The mass 9 can be external to the flexible material comprising the body section 3 and gripping section 4 but is preferably enclosed within the flexible material of the gripping section 4. More preferably the lightweight mass 9 is a soft resilient cylindrical mass 9 and constructed of closed cell polyethylene foam because of its firm soft lightweight characteristics and its ability to keep the device 1 afloat in water. The longitudinal axis 12 of the cylindrical mass 9 is longer than the diameter 13 of the cylinder. The cylindrical mass 9 is positioned in the gripping section 4 so that the longitudinal axis 12 is perpendicular to the long axis of the body section 3. The cylinder diameter 13 is smaller than the longitudinal axis 12 to allow for a smooth release when throwing. The longitudinal axis 12 is larger than the cylinder diameter 13 to provide a greater surface area on the gripping section 4 which prevents the trailing portion 3, 4 from sliding out of the catcher's relaxed hand 14. If the cylindrical mass 9 dimensions are too large, the release becomes awkward. If the cylindrical mass 9 dimensions are too small, the trailing portion 3, 4 slides out of a relaxed hand 14 too easily. Other shapes such as a spherical, conical or ellipsoid could be used but a sphere and cone do not have the advantage of simultaneously having a large dimension to benefit catching and a smaller dimension to benefit throwing. An ellipsoid shape is more expensive to manufacture than a cylindrical shape. Overall recommended length of the device 1 depends on the height of the thrower. The longer the trailing portion 3, 4 the easier a catch by the trailing portion 3, 4 becomes. But, if the device 1 is made too long, the device 1, becomes unwieldy to spin at the thrower's 15 side because of interference by the ground.

Figure 6:
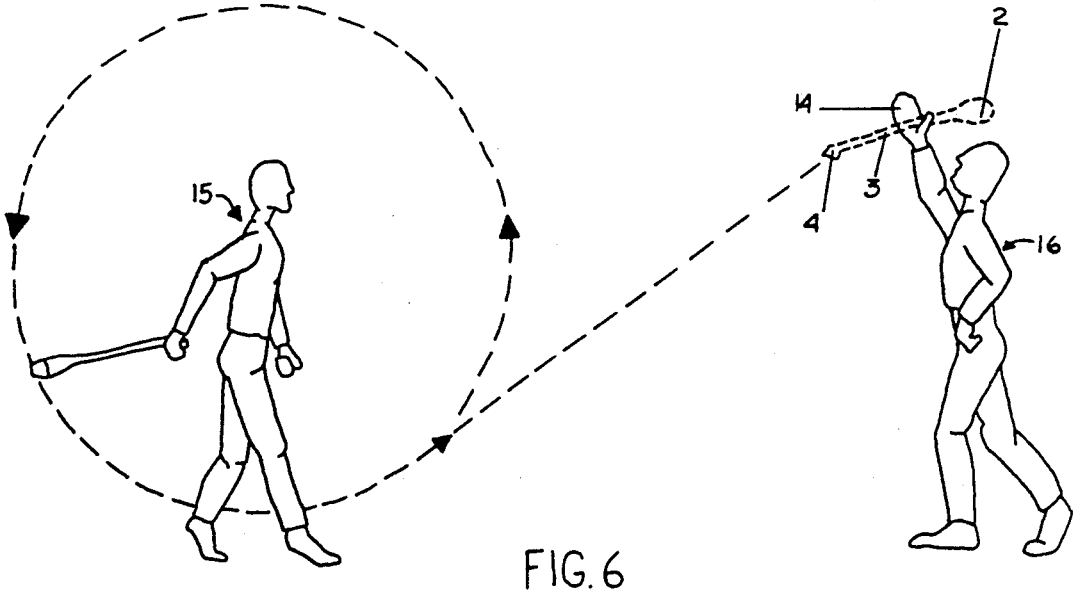
FIG. 6 is a diagram of the projectile device in use.

FIG. 6 illustrates the device 1 in use. The thrower 15 spins the device 1 to generate rotational velocity and releases the gripping section 4 at the proper moment to send the device 1 on a flight path to the catcher 16 who can easily catch the device 1 by the nose section 2 or the trailing portion 3, 4. The device 1 is easy to catch and throw because of the unique options available to the user. The gripping section 4 can be easily retained in a relaxed hand 14 even with the hand 14 completely open. This allows catches to be made effortlessly as the body section 3 slides between fingers or fingers and thumb but is retained in the hand 14 by the wider gripping section 4. Catches that are extremely difficult with other projectile devices become easy and routine with this device 1. If the catcher 16 elects to catch the device 1 by the nose section 2, the non resilient nature of the particulate filled nose section 2 allows the nose section 2 to sink securely into the hands of the catcher 16 resulting in more successful catches than would be achieved with a resilient mass. The device 1 is uniquely easy to throw because hand strength is not necessary to retain the device 1 while it is spinning prior to release.

While the above description contains many specificities, these should not be construed as limitations on the scope of the invention, but rather as an exemplification of one preferred embodiment thereof. Many other variations are possible. For example the body section 3 could be constructed of lightweight fibers or cord. The nose section 2 could be of any shape and constructed from any variety of different sized and shaped panels. Accordingly, the scope of the invention should be determined not by the embodiment illustrated, but by the appended claims and their legal equivalents.

I claim:

1. A centrifugally launched projectile device comprising:

a) a nose section comprising a flexible material encasing a substantially heavy weight;

b) a substantially flexible elongate body section adjacent to and extending from said nose section; and c) a gripping section adjacent to said body section at the end distal to said nose section comprising a flexible material and a lower density, lightweight mass of sufficient size to prevent said mass from sliding between the fingers of an open human hand whereby said projectile device, by means of the unique configuration of all elements, maximizes the ease of both throwing and catching said device.

2. The centrifugally launched projectile device according to claim 1, in which said substantially heavy weight of said nose section is comprised of a plurality of particles loosely dispersed and partially filling said nose section such that said particles are capable of being in substantially fluid motion within said nose section whereby said nose section is substantially non-resilient and flexible permitting said nose section to absorb impact.

3. The centrifugally launched projectile device according to claim 2, in which the cross sectional area of said gripping section is substantially larger than the cross sectional area of said body section.

4. The centrifugally launched projectile device according to claim 3, in which the approximate size of said gripping section is the size of an object which fits into a partially closed human hand whereby virtually no hand strength is required to throw or catch the object.

5. The centrifugally launched projectile device according to claim 4, in which said gripping section comprises a lightweight, durable mass of sufficiently low weight whereby during flight said body section and gripping section follow in an essentially linear path behind said weighted nose section.

6. The centrifugally launched projectile device according to claim 5, in which said lightweight mass is selected from the group essentially including cork, wood, plastic, foam and synthetic polymers.

7. The centrifugally launched projectile device according to claim 6, in which said mass of said gripping section is substantially cylindrically shaped.

8. The centrifugally launched projectile device according to claim 7, in which the longitudinal axis of said substantially cylindrical mass of said gripping section is longer than the diameter of said mass.

9. The centrifugally launched projectile device according to claim 8, in which said mass is positioned such that said longitudinal axis of said mass is perpendicular to the long axis of said body section of said device.

10. The centrifugally launched projectile device according to claim 9, in which said cylindrically shaped mass is comprised essentially of closed cell foam.

11. The centrifugally launched projectile device according to claim 5, in which said gripping section comprises a soft, firm, resilient, lightweight durable mass enclosed within said flexible material of said gripping section.

* * * * *